US005348250A

United States Patent [19]

Semler et al.

[11] Patent Number: 5,348,250

[45] Date of Patent: Sep. 20, 1994

[54] ARRANGEMENT FOR CONTROLLING THE COOLANT SUPPLY TO A COOLER FOR THE DETECTOR OF AN OPTICAL SEEKER IN A MISSLE

[75] Inventors: Gerd Semler, Frickingen; Winfried Zeischke, Steisslingen, both of Fed. Rep. of Germany

[73] Assignee: Bodenseewerk Gerätetechnik GmbH, Bodensee, Fed. Rep. of Germany

[21] Appl. No.: 91,571

[22] Filed: Jul. 15, 1993

[30] Foreign Application Priority Data

Aug. 6, 1992 [DE] Fed. Rep. of Germany ..... 4226024

[51] Int. Cl.[5] ..... F41G 7/26; F41D 5/00; F25B 19/02

[52] U.S. Cl. ..... 244/3.16; 89/1.56; 89/1.819

[58] Field of Search ..... 89/1.819, 1.56; 244/3.16, 3.17; 102/213

[56] References Cited

U.S. PATENT DOCUMENTS

| | | | |
|---|---|---|---|
| 4,246,472 | 1/1981 | Sun et al. | 89/1.56 |
| 4,457,475 | 7/1984 | Ahlström | 244/3.16 |
| 4,745,840 | 5/1988 | Long | 89/1.819 |
| 4,911,059 | 3/1990 | Brueckner | 89/1.819 |
| 4,917,330 | 4/1990 | Dulot et al. | 244/3.16 |
| 5,077,979 | 1/1992 | Skertic et al. | 244/3.16 |
| 5,184,470 | 2/1993 | Moser et al. | 244/3.16 |
| 5,187,939 | 2/1993 | Stertic et al. | 244/3.16 |
| 5,219,132 | 6/1993 | Beckerleg et al. | 244/3.16 |

FOREIGN PATENT DOCUMENTS 3611206 10/1987 Fed. Rep. of Germany .

*Primary Examiner*—David H. Brown

*Attorney, Agent, or Firm*—Lowe, Price, LeBlanc & Becker

[57] ABSTRACT

The coolant supply to a cooler for the detector of an optical seeker in a missile is to be controlled; the missile is arranged in a launcher attached to an aircraft. A caging device for caging the movable seeker optical system of the seeker is provided in the seeker. For target tracking, this caging device is releasable, before operation of the missile, by a release signal through a control line extending from the cockpit of the aircraft to the launcher. This control line is simultaneously used for controlling the coolant supply by providing a bistable circuit on the missile side of the control line, activation of the coolant supply being effected by setting the bistable circuit, the setting and resetting of the bistable circuit being determined by the variation in time of the release signal.

5 Claims, 2 Drawing Sheets

ARRANGEMENT FOR CONTROLLING THE COOLANT SUPPLY TO A COOLER FOR THE DETECTOR OF AN OPTICAL SEEKER IN A MISSLE

The invention relates to a device for controlling the coolant supply to a cooler for the detector of an optical seeker in a missile, which is arranged in a launcher attached to an aircraft. Caging means for caging the movable seeker optical system of the seeker are provided. These caging means are releasable, for target tracking, before the missile is launched. The caging means are released by an "uncage" signal through a control line extending from the cockpit of the aircraft to the launcher.

Target seeking missiles are known. Such missiles have an optical seeker, which detects targets and supplies control signals, by which the missile is guided to the target. The optical seeker is generally located on a gyro rotor and is thereby decoupled from the yaw, pitch and roll movements of the missile. The gyro rotor is gimbal suspended and, in this respect, movable relative to the airframe of the missile, such that it can be oriented towards a target. DE-C-3 623 343 shows an example of such an optical seeker.

The missiles are usually supported in a launcher. The launcher is attached to an aircraft, usually under the wings.

It is known to cage such seekers to a fixed initial position before the firing of the missile and the target tracking preceding the firing. This caging is released through a control line from the cockpit of the aircraft, when the missile is to be made ready for target tracking and firing.

Such seekers generally respond to infrared radiation emitted by the target. Therefore, the seeker has a detector responding to infrared radiation. The sensitivity of such detectors is heavily dependent on temperature. It is known to cool detectors for optical seekers in order to increase the sensitivity and to avoid background noise.

Furthermore, it is known to cool the detector by Peltier elements. However, the cooling effect of such Peltier elements is limited. Therefore, coolers are known, which make use of the Joule-Thomson-effect. The Joule-Thomson-effect is based on the expansion of pressurized gas. An example of such a cooler is described in DE-A-3 611 206.

Prior to the target acquisition, it is necessary to activate the supply of coolant to the cooler. This can be done through an additional control line, through which a valve for the coolant is opened. Such an additional control line requires additional expenditure. In launchers originally provided for older types of missiles without Joule-Thomson cooling of the detector, such a second control line is not present.

It is the object of the invention to provide a device for controlling the coolant supply to a cooler of the detector of an optical seeker in a missile, which is arranged in a missile launcher of an aircraft, wherein no additional control line is required for the activation of the cooling device.

In particular, it is the object of the invention to make older launchers which do not have a particular activating device for the cooling of the detector suitable for use with missiles, in which cooling of the detector is effected by means of a Joule-Thomson cooler.

Furthermore, it is the object of the invention to provide a device of the mentioned type for controlling the coolant supply, wherein the coolant supply can both be turned on and be turned off.

Finally, it is the object of the invention, in an arrangement of the mentioned type, to avoid operating errors, particularly unintentional turning-off of the coolant supply.

According to the invention these objects are achieved in that (a) a bistable circuit is provided on the missile side of the control line, (b) the releasing of the coolant supply is effected by setting the bistable circuit, (c) the setting and resetting of the bistable circuit is determined by the variation in time of the release signal.

The control line through which the caging of the seeker is released, at the same time, serves for the releasing or for the shutting-down of the coolant supply. No additional control line is required for this function. The device can also be used in conjunction with launchers which are not provided with such an additional control line. By the fact that the setting and resetting of the bistable circuit is determined by the variation in time of the release signal, it is possible to optionally release or shut down the coolant supply by correspondingly different variations in time of the release signal. Operating errors due to unintentional touching of a release button are ruled out to a large extent, because well defined variations in time, for example actuation of the release button several times within a predetermined time interval, are required for the setting and resetting of the bistable circuit.

An embodiment of the invention will now be described in greater detail with reference to the accompanying drawings.

Figure 1:
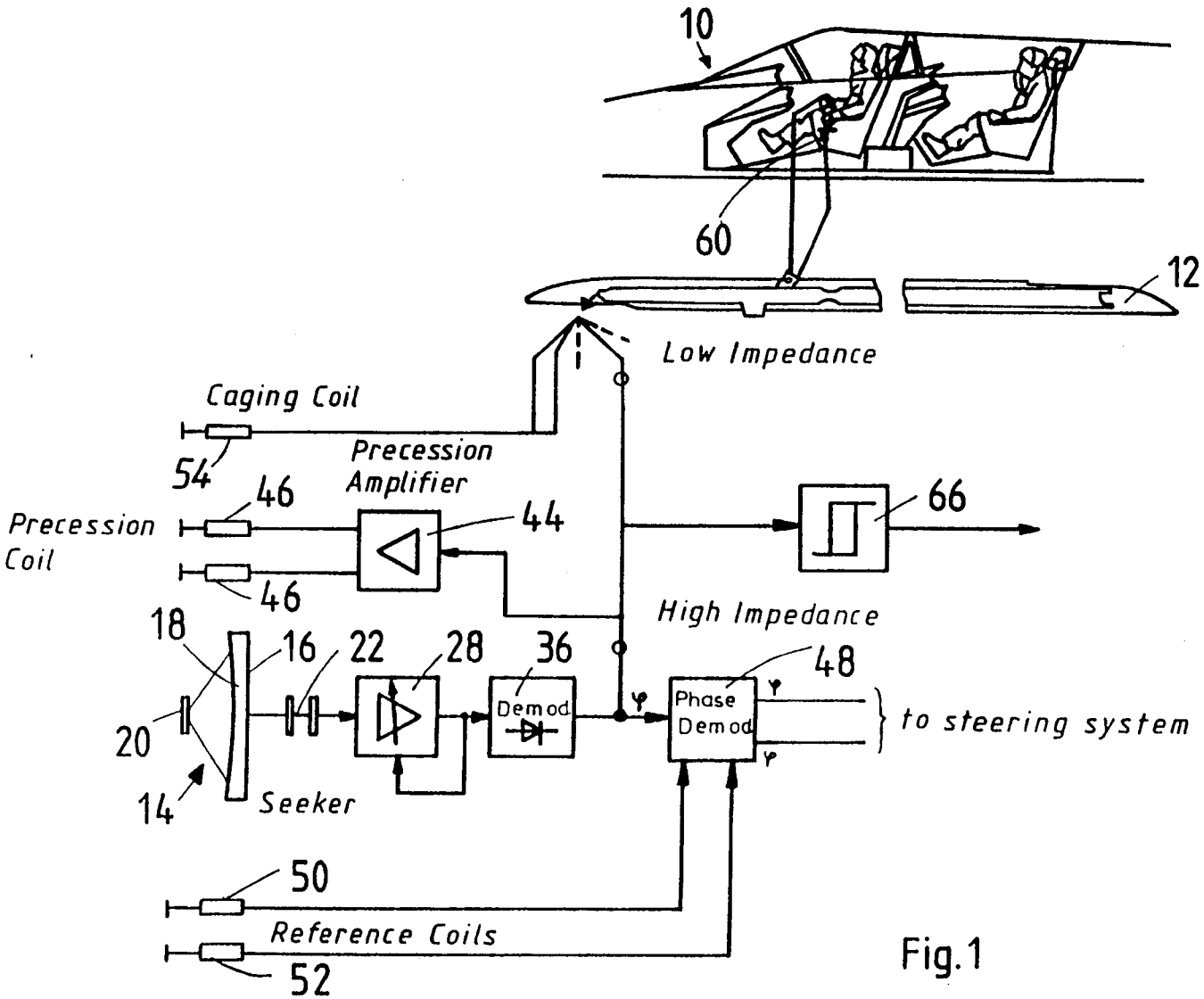
FIG. 1 is a schematical illustration and shows the caging of the seeker in a missile-fixed position and the releasing of this caging.

In FIG. 1 numeral 10 designates a cockpit of an aircraft. A launcher 12 for a missile is attached to the aircraft.

The missile is provided with a seeker 14. As clearly illustrated in FIG. 2, the seeker 14 comprises a rotor 16. The rotor 16 is rotatable about an axis of rotation and, furthermore, suspended on gimbals, such that its axis of rotation can be oriented to point to a target. The rotor is driven by means of a driving coil 17. The rotor 16 carries a mirror optical system, which is adapted to scan a field of view substantially located at infinity. The mirror optical system comprises an annular concave mirror 18, the optical axis of which coincides with the axis of rotation of the rotor 16 and which is concentric to this axis of rotation. The concave mirror 18 faces the field of view. The mirror optical system further comprises a plane mirror 20, the reflecting surface of which faces the concave mirror 18. The plane mirror 20 is slightly inclined with respect to the axis of rotation of the rotor 16. This causes a gyrating motion of the image of the field of view in the image plane. A further optical system 22 of infrared- transparent refractive elements is located within the rotor 16. The path of rays extends from the field of view located at infinity through the concave mirror 18, the plane mirror 20 and the optical system 22. When the rotor 16 is rotating, the optical system provides a gyrating image of the field of view in the plane of a modulator diaphragm (not shown). An infrared sensitive detector 24 is located behind the modulator diaphragm.

The obtained detector signal is applied through a pre-amplifier 26 to an AGC-unit 28 for the automatic gain control. The AGC-unit 28 comprises a control element 30 in the signal channel. The control element 30 is energized by a controller 32. The controller 32 compares the controlled voltage at the output of a band-pass filter 34 with a desired value, which is applied to an input 35.

The thus obtained voltage is applied to a demodulator circuit 36. The demodulator circuit 36 comprises a further band-pass filter 38, a frequency demodulator 40 and an amplitude demodulator 42. The detector signal caused by a target is subject to a frequency modulation, which is a function of the deviation of the target from the axis of rotation of the rotor 16. The demodulation by means of the frequency demodulator 40 provides a signal, the amplitude of which is a function of the deviation and the phase of which is a function of the direction of the deviation of the target. This "target deviation" signal is applied through a precession amplifier 44 in a target tracking loop to precession coils 46. The rotor 16 is radially magnetized. The precession coils 46 surround the rotor 16. Thereby, cyclical torques are exerted on the rotor 16 by the coils due to the signals from the precession amplifier. The torques are exerted at such moments of the rotation cycle, that the rotor is precessed toward the target.

The signal applied to the precession amplifier 44 from the demodulator circuit 36 is, at the same time, applied to a phase demodulator 48. The phase demodulator 48 receives reference voltages from reference coils 50 and 52. These reference coils 50 and 52 are missile-fixed and supported beside the rotor 16. The reference coils 50 and 52 generate two reference voltages out of phase by 90° in accordance with the rotary movement of the rotor 16. From the target deviation signal of the demodulator circuit 36, the phase demodulator 48 generates, as a function of the phase of this target deviation signal, d.c. signals, which correspond to the "components" of the target deviation with respect to a missile-fixed coordinate system. These d.c. signals are applied to the steering system of the missile.

Furthermore, a caging coil 54 is provided. The caging coil 54 supplies a signal depending on the seeker position. By applying this signal to the precession coil 46, the seeker 14 is restrained in a missile-fixed position. The caging can be released by opening a relay contact 56. The relay contact 56 belongs to a relay 58, which is arranged to be energized manually through a push button 60. The relay 58 with the contact 56 and the push button 60 are provided in the aircraft. The relay contact 56 is connected to the missile through a control line 62. The separating line between aircraft and missile is indicated by dot-dash lines in FIG. 2. The caging signal from the caging coil 54 and the target deviation signal from the demodulator circuit 36 are applied to a summing point 64 (FIG. 2), which represents the input of the precession amplifier 44. As indicated in FIG. 1, the caging signal from the caging coil 54 is applied with a low impedance through the relay contact 56. In contrast thereto, the target deviation signal from the demodulator circuit 36 is applied to the summing point 64 through a high impedance. When the relay contact 56 is closed, the high-resistance target deviation signal has practically no effect. The seeker 14 is caged in the missile-fixed position by the caging signal from the caging coil 54. When the relay contact 56 is opened, only the target deviation signal from the demodulator circuit 36 is applied to the precession coil 46 through the precession amplifier. The seeker 14 is precessed to point to an acquired target.

The caged and uncaged states are detected by a comparator or Schmitt-trigger circuit 66.

The detector 24 is cooled by a Joule-Thomson cooler (not shown). The coolant supply to the Joule-Thomson cooler is governed by a coolant valve 68. The coolant valve 68 is located in a coolant conduit 70. A solenoid 72 is arranged to open the coolant valve 68. The coolant can be supplied from a coolant reservoir 74 arranged in the missile. The coolant reservoir 74 supplies the coolant, if an external supply from the launcher is not available. In addition, coolant is supplied from a coolant reservoir in the aircraft through a conduit 76. This coolant supply is effective, as long as the missile is retained in the launcher 12 of the aircraft.

If a separate switch 76 and a separate control line 78 for switching the coolant supply on and off are provided in the aircraft, the solenoid 72 is controlled through this control line 78. The solenoid 72 is energized when the switch 76 is closed. However, aircrafts exist, in which the control line 78 is not present. When using the missile in such aircraft, the coolant supply is switched on and off through suitable actuation of the push button 60 provided for the release of the caging of the seeker 14. This is achieved in the following way:

A bistable circuit 80 is provided. The bistable circuit 80 can be set by a first input 82 and can be reset by a second input 84.

A first timer 86 is switched on by the output signal from the bistable circuit 66 through an input 88 when the relay contact 56 is opened. The timer 86 is a preselection counter with an oscillator or a monostable circuit and supplies an output signal at an output 90 after a predetermined period of time, for example after two seconds. The output 90 is connected to the input 82 of the bistable circuit 80. The timer 86 is reset, when the signal at its input 88 disappears, before said predetermined period of time has elapsed. After the bistable circuit 80 has been set, this bistable circuit supplies an output signal at an output 92. Like the signal on the control line 78, this output signal is applied to the solenoid 72 through a summing point, 94.

A second timer 96 is likewise triggered by the output signal from the bistable circuit 66 through an input 98, when the relay contact 56 is opened. The second timer 96 is a preselection counter with an oscillator. The second timer supplies an output signal at an output 100 after a predetermined period of time, for example also after a period of time of two seconds. Differently from the output signal at the output 90 of the timer 86, this output signal is present independently of whether the input signal at the input 98 is still present or has disappeared during the said predetermined period of time.

The output signal of the bistable circuit 66 is finally applied to a counting input 102 of a preselection counter 104. The preselection counter 104 supplies an output signal to an output 106 when a predetermined count is attained, for example the count "4". This output signal is applied through a summing point 108 to the input 84 of the bistable circuit 80. Such an output signal resets the bistable circuit 80. By the resetting of the bistable circuit 80 the solenoid 72 is deenergized and the coolant valve 68 is closed.

The described arrangement for controlling the coolant valve 68 operates as follows:

In order to open the coolant valve, the push button 60 is pressed down for a period of time of more than two seconds. Correspondingly, the relay 58 is energized and the relay contact 56 is opened. The comparator circuit 66 supplies an output signal indicating the release of the caging. This output signal triggers the timer 86. The timer 86 supplies an output signal at the output 90 after two seconds, the "predetermined period of time" of this timer 86. This output signal sets the bistable circuit 80. The signal thus present at the output 92 energizes the solenoid 72 and opens the coolant valve 68. The coolant valve 68 remains in this state as long as the bistable circuit 80 is set. The preselection counter 104 is set to the count "1" through the count input 102 and is reset to zero again after two seconds, the "predetermined period of time" of the timer 96. This does not cause a reset signal at the input 84.

In order to close the coolant valve 68, the pilot has to press the push button four times in fast sequence, within two seconds. With each actuation the preselection counter 104 counts one step up. At a count of "4" the preselection counter applies, at its output 106, a reset signal to the input 84 of the bistable circuit 80. Then, the bistable circuit 80 is reset and the coolant valve is closed. The preselection counter 104 is reset subsequently, that is after the predetermined period of time of two seconds has elapsed.

In this way, using the signal line for the release of the caging, it is possible not only to release the coolant supply to the Joule-Thomson cooler of the detector 24 but also to shut the coolant supply off again. This control requires the push button 60 either to be pressed down for a long time or to be pressed down in a fast sequence. In practice, this procedure rules out any unintensional release or interruption of the coolant supply.

In the initial state, while the aircraft approaches a target region, the coolant supply is shut off. Then, the coolant supply is initiated by the pilot pressing down the push button 60 during a period of time of two seconds. If it turns out, that firing of the missile is not necessary, for example because another missile has already been fired, the coolant valve 68 can be closed again by the pilot actuating the push button 60 four times in sequence during the predetermined period of time of two seconds.

Figure 2:
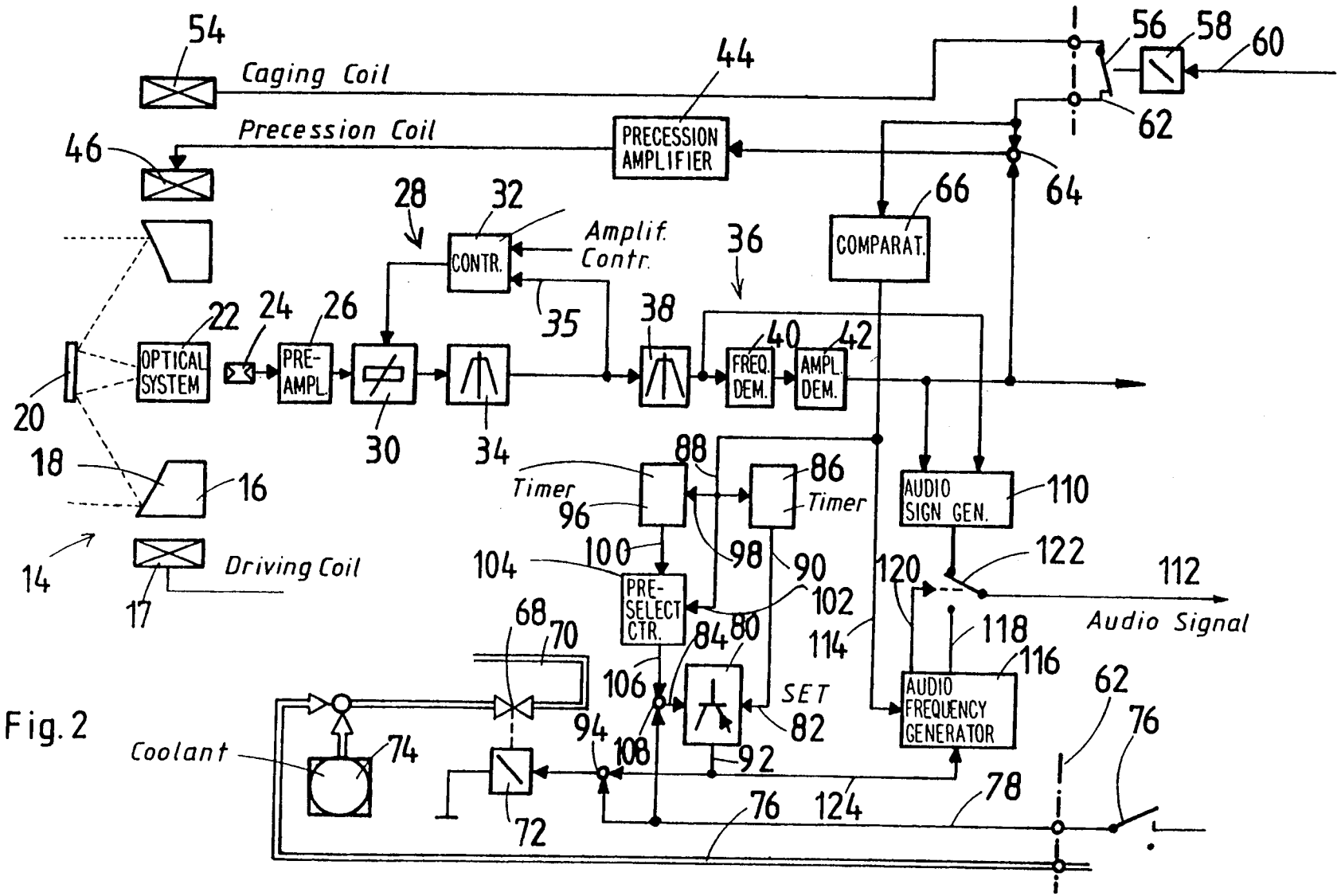
FIG. 2 is a schematical illustration of the seeker with a block diagram of the signal processing and the control of seeker caging and coolant release.

The filtered and demodulated detector signal is detected by a device 110 and supplied as audio signal to an output 112. The audio signal is transmitted acousticly to the pilot. When the bistable circuit 66 has been switched over, an audio frequency generator 116 for generating a synthtic audio signal is controlled through line 114, depending on the initial state of the bistable circuit 80, to generate a synthetic audio signal. This synthetic audio signal is mixed into the audio signal at different time intervals depending on whether the bistable circuit 80 is set or reset. This is illustrated in FIG. 2 by an output 118 and a switch 122 controlled through a control line 120. If, however, the bistable circuit 80 has already bben set, i.e the solenoid valve 72 has already been energized through output 92 of the bistable circuit 80, the audio frequency generator 116 remains de-energized through output 92 and a line 124. Then, by means of the acoustic signals generated by the circuit 110, the pilot can recognize whether the seeker 14 has acquired a target properly. Moreover, the acoustic signal indicates to the pilot, that the coolant supply is switched on. However, no additional audio signal is generated, when the push button 60 is actuated once again, while the coolant supply is already operative, in order to release the caging of the seeker 14 by opening the relay contact 56.

We claim:

1. A device for controlling the coolant supply from a reservoir to a cooler for a detector (24) of an optical seeker (14) in a missile, which is arranged in a launcher (12) attached to an aircraft, comprising coolant control means governing the coolant supply from said reservoir to said cooler, and caging means (54, 46) for caging the movable seeker optical system (18, 20) of the seeker (14), which are releasable for target tracking before the operation of the missile by a release signal through a control line extending from the cockpit (10) of the aircraft to the launcher (12), said control line having an aicraft end and a launcher end characterized in that (a) a bistable circuit (80) is provided on said missile end of said control line, (b) said coolant control means being controlled by said bistable circuit (80) to release or shut off the coolant supply depending setting or resetting of said bistable circuit (80), (c) the setting and resetting of the bistable circuit (80) being determined by a predetermined variation in time of said release signal.

2. A device as claimed in claim 1, characterized in that a timer (86) is arranged to be triggered by said release signal is provided, the output (90) of said timer setting said bistable circuit (80) after a predetermined time interval has elapsed, when said timer (86) has not been de-activated before said release signal has disappeared.

3. A device as claimed in claim 1 and further comprising (a) a timer (96) started by said the release signal, said timer being arranged to generate, after a predetermined time interval, a reset signal independently of whether the release signal continues to be applied or not, and (b) a preselection counter (104), which counts changes of said release signal, supplies a reset signal after a preselected number of such changes of said release signal, said reset signal being applied to said bistable circuit (80) to reset said bistable circuit to its non-set state, (c) the reset signal of said timer (96) being applied to said preselection counter (80) to reset the preselection counter (80).

4. A device as claimed in claim 1, and further comprising (a) acoustic indicating means and means in said seeker for energizing said acoustic indicating means depending on the target acquisition, and (b) an audio frequency generator (116) and means for controlling said audio frequency generator by said release signal to generate different audio signals, the coolant supply is released or shut off, said audiosignals being applied to said acoustic indicating means.

5. A device as claimed in claim 4, characterized in that said audio frequency generator (116) is turned off when said bistable circuit (80) is set.

* * * * *